United States Patent [19]

Baker, III

[11] 4,253,533

[45] Mar. 3, 1981

[54] VARIABLE WEAR PAD FOR CROSSFLOW DRAG BIT

[75] Inventor: William Baker, III, Costa Mesa, Calif.

[73] Assignee: Smith International, Inc., Newport Beach, Calif.

[21] Appl. No.: 91,649

[22] Filed: Nov. 5, 1979

[51] Int. Cl.[3] ..... E21B 10/46

[52] U.S. Cl. ..... 175/329; 175/409; 175/410

[58] Field of Search ..... 175/329, 330, 409, 410, 175/374

[56] References Cited

U.S. PATENT DOCUMENTS

| | | | |
|---|---|---|---|
| 2,644,672 | 7/1953 | Mathews | 175/329 X |
| 3,322,218 | 5/1967 | Hildebrandt | 175/330 |
| 3,693,735 | 9/1972 | Cortes | 175/329 |
| 3,765,493 | 10/1973 | Rosar et al. | 175/329 X |
| 3,825,080 | 7/1974 | Short | 175/329 X |
| 4,128,136 | 12/1978 | Generoux | 175/330 |

*Primary Examiner*—Stephen J. Novosad
*Attorney, Agent, or Firm*—Robert G. Upton

[57] ABSTRACT

A diamond studded insert drag bit is disclosed having a multiplicity of individual diamond insert cutter blanks inserted in the face of the bit. The diamond insert blanks are so positioned to maximize penetration of the bit in a borehole. The bit further includes one or more wear pads adjacent the multiplicity of diamond insert cutter blanks, the wear pads serving to channel the flow of drilling mud emanating from fluid passages formed in the face of the bit. The wear pads seal off a portion of the borehole bottom thereby directing hydraulic fluid across the face and over each of the strategically positioned diamond cutter blanks.

14 Claims, 4 Drawing Figures

VARIABLE WEAR PAD FOR CROSSFLOW DRAG BIT

BACKGROUND OF THE INVENTION

1. Field of the Invention

This invention relates to diamond studded insert drag bits.

More particularly, this invention relates to drag bits with a multiplicity of individual diamond faced tungsten carbide inserts mounted in the face of the drag bit with wear pads forming hydraulic passages on adjacent sides of the face of the drag bit to direct hydraulic fluid over the inserts to cool and clean the diamond faced insert blanks.

2. Description of the Prior Art

Most state of the art diamond drag bits are designed with the first consideration given to location of the individual diamond cutter inserts.

For example, U.S. Pat. No. 4,098,363 discloses a diamond drill bit employing spaced, shaped diamond cutter elements arranged in rows separated by large fluid channels. The channels are formed in the bit body and are utilized for bit cleaning and detritus removal action. A series of nozzles are randomly placed within the channels. The channels themselves distribute the fluid or drilling mud over the array of diamond cutters. This type of bit is normally fabricated from a material which is highly resistant to erosion, especially where fluid channels are provided in the face of the bit. The diamond drill bit just described is cast from expensive carbide material with the waterway channels formed therein to provide an erosion resistant face for the bit body.

This patent is disadvantaged in that the cutting face of the bit is directly exposed to the hole bottom. In other words, as the bit rotates the cutting edge of the diamond inserts come in full contact with the hole bottom and are subjected to a rapid wear rate and insert breakage. Since the diamond inserts are fully exposed to the hole bottom, the inserts, as well as the supporting structure, would necessarily have to be fabricated from a highly wear resistant material.

In drag bit designs utilizing diamond bit hydraulic theories, the cleaning action is very good. Unfortunately, as the diamond drag cutter wears, the bit body "bottoms-out" and insufficient weight is applied to the drag cutters. Diamond bits typically have bottom hole standoffs of 0.100" while the diamond drag cutter stands some 0.500". To fully utilize the potential economic life of the diamond drag cutter, it must be kept in engagement with the rock and kept clean through all phrases of the drilling operation. The hydraulic design needs to vary with cutter wear to maintain cleaning.

The diamond studded insert and drag bit of the present invention protect the insert studs which are inserted within the face of the drag bit. The basic material of the drag bit need not be highly wear resistant since the face of the bit is not directly exposed to the hole bottom. By utilizing one or more wear pads on the face of the drag bit to form fluid passages to direct fluid over the diamond inserts, the wear pad easily conforms to the hole bottom and protects the majority of the diamond inserts in the channels formed by the wear pad on the face of the drag bit. As the tips of the diamond inserts contact the hole bottom, the wear pads conform to the hole bottom thereby forming a seal between the hole bottom and the bit to direct hydraulic mud through the channels and over the diamond tipped cutters. As the diamond tips wear down the wear pad is equally worn so that a constant drag bit penetration rate is maintained. The best economic use of the drag cutters is made when good hydraulics are maintained throughout the cutter life. The wear pads limit penetration of each of the individual diamond cutters, thus protecting the inserts from breakage that could occur if the inserts embed themselves too deeply in the borehole bottom.

The wear pads may be fabricated from a variety of relatively soft materials ranging from assorted plastics to aluminum, copper, bronze or mild steel depending upon the rock bit formations in which the drag bit is utilized.

SUMMARY OF THE INVENTION

It is an object of this invention to provide one or more wear pads connected to the face of a drag bit to form hydraulic passages to direct hydraulic fluid across the borehole bottom.

More particularly, it is an object of this invention to provide at least a pair of wear pads which provide a channel for hydraulic mud, to direct the mud over the diamond inserts, the wear pads providing a seal between the borehole bottom and the face of the diamond studded rock bit. The wear pads wear down along with the inserts to assure maximum penetration of the drag bit in the borehole.

A diamond studded insert drag bit apparatus is disclosed having a multiplicity of individual diamond insert cutter blanks inserted in the face of the bit. The drag bit forms at least one hydraulic passage that communicates between the face of the bit and an interior chamber formed by the bit. The drag bit additionally forms a substantially cylindrical body having a relatively flat first face end and a second pin end. At least one wear pad has a support base at one end and a wear surface at an opposite end, the pad being attached to the first face end of the drag bit body at the support base of the wear pad. The wear pad is positioned adjacent the multiplicity of diamond inserts, the wear surface extends beyond the first face end of the drag bit. The diamond cutting tips of the diamond insert cutter blanks extend partially beyond the wear surface of the pad, the pad forming at least one hydraulic passage between the first face end of the drag bit and a borehole bottom to direct hydraulic fluid exiting the at least one hydraulic passage over the adjacent multiplicity of diamond inserts to cool and clean the inserts and to remove detritus material from the borehole bottom. The wear pad assumes the shape of the borehole bottom to affect a hydraulic seal between the borehole bottom and the face of the drag bit.

An advantage over the prior art then is the use of the wear pads in a rock bit to direct hydraulic fluid across the face of the bit and through the multiplicity of diamond inserts.

Yet another advantage over the prior art is the use of the wear pads to allow only the tips of the multiplicity of diamond inserts to contact the borehole bottom thereby preventing the full face of each of the multiplicity of diamond inserts from contact with the borehole bottom.

Still another advantage over the prior art is the ability to affect a hydraulic seal between the borehole bottom and the face of the drag bit to direct most of the hydraulic fluid across the cutting face of the drag bit.

Another advantage over the prior art is the ability to maintain a cutting edge of all of the multiplicity of diamond inserts in the face of the drag bit as the bit is advanced in the borehole. For example, as the tips of the diamond inserts wear down the wear pads wear down accordingly thus allowing the cutting tips of the diamond inserts to maintain contact with the borehole bottom.

Yet another advantage over the prior art is the use of a steel drag bit body as opposed to a very hard erosion resistant material to form the drag bit bodies, thus facilitating ease of manufacture and a means to economize the fabrication of the rock bits.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
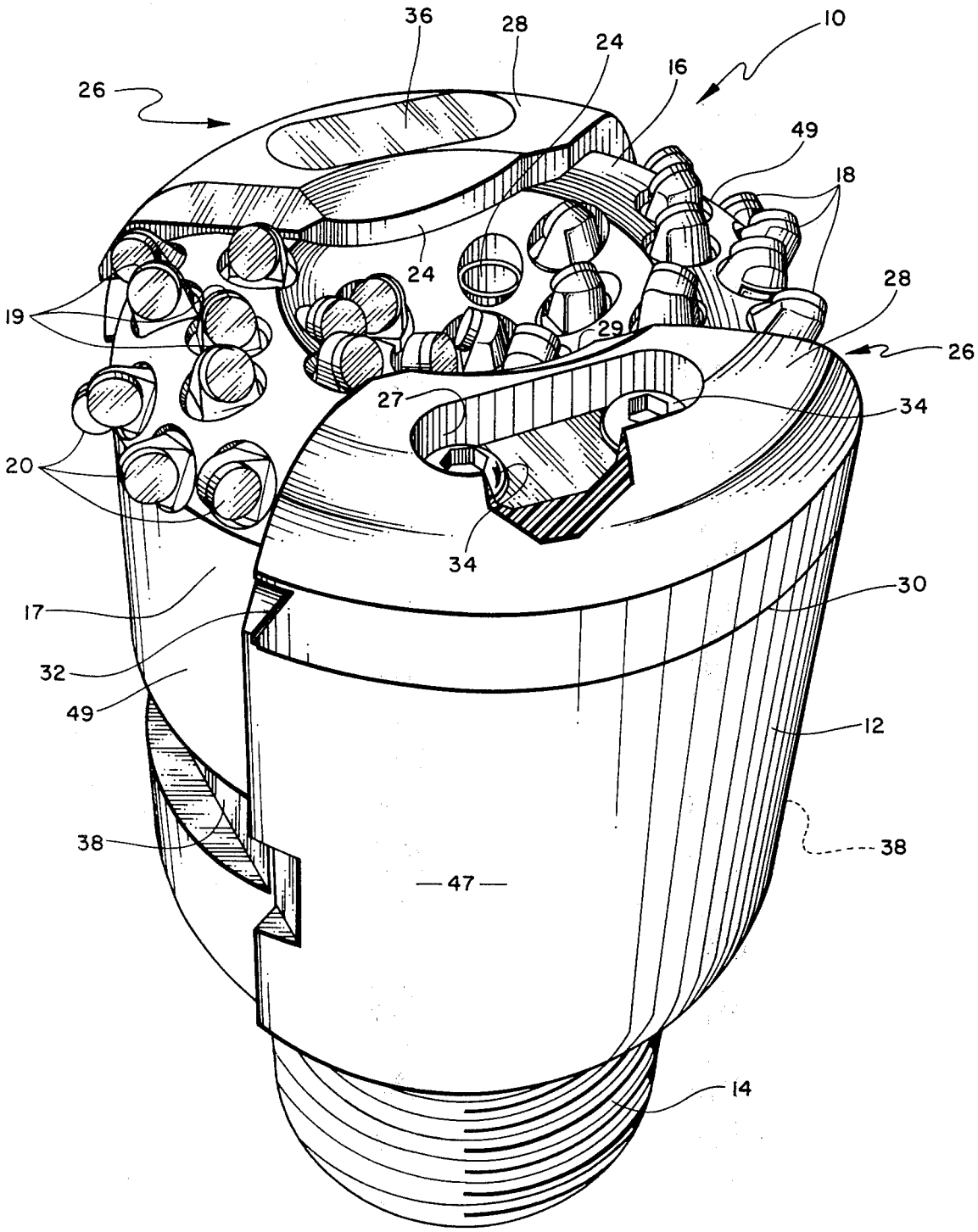
FIG. 1 is a perspective view of a diamond studded drag bit body with individual diamond insert blanks inserted in the face of the bit with a pair of wear pads positioned on either side of the face of the bit forming a hydraulic passage between the wear pads.
Figure 3:
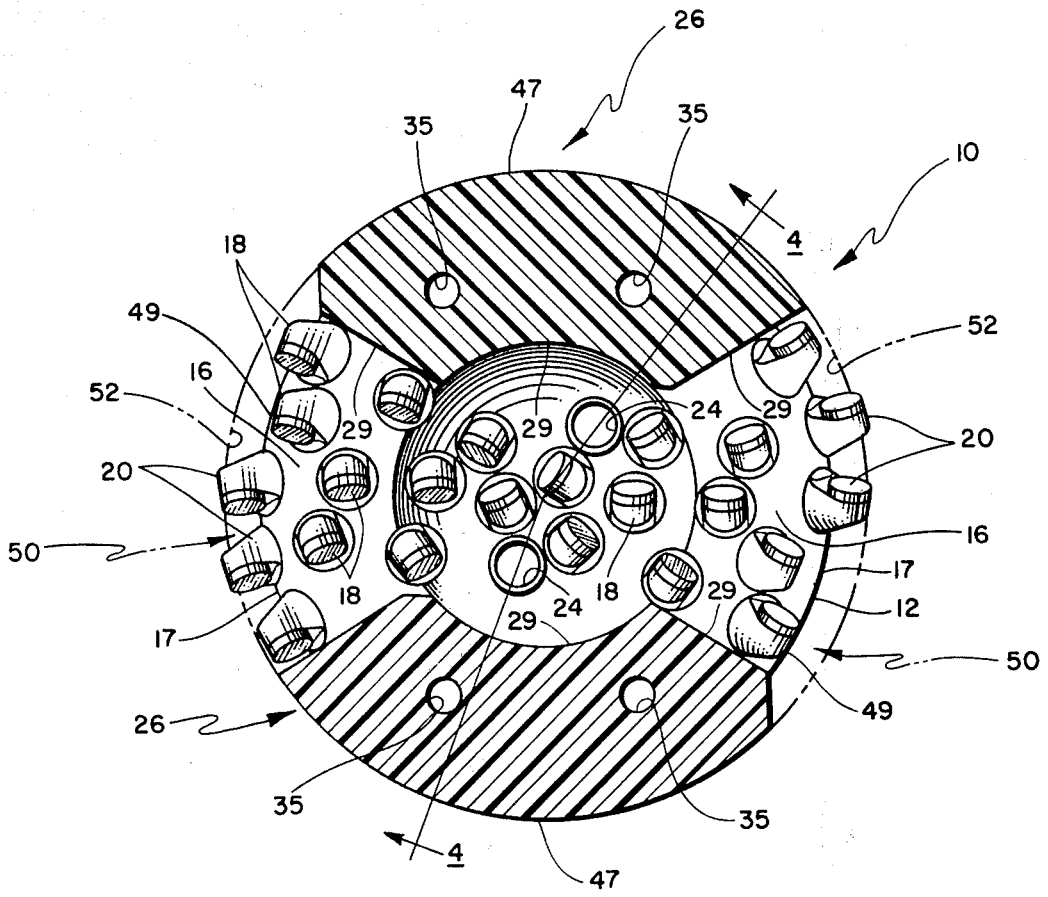
FIG. 3 is a partially cutaway top view of the drag bit body illustrating the location of the wear pads forming the hydraulic passage to direct hydraulic fluid over the multiplicity of diamond inserts.

Turning now to the perspective view of FIG. 1, the diamond studded insert drag bit, generally designated as 10, consists of a drag bit body 12 having a pin end 14 and a face end 16. Face end 16 has a multiplicity of diamond insert cutter blanks 18 inserted in insert holes formed by the bit body 12. The insert blanks 18, for example, are fabricated from a tungsten carbide substrate with a diamond layer sintered to a face of a substrate, the diamond layer being composed of a polycrystalline material. The synthetic polycrystalline diamond layer is manufactured by the Specialty Material Department of General Electric Company of Worthington, Ohio. The foregoing drill cutter blank is known by the trademark name of Stratapax drill blanks. The series of inserts 18 are strategically placed within face 16 of drag bit body 12 to best advance the drill bit in a borehole. A series of diamond inserts 20 are positioned around the peripheral edge 17 of bit body 12 to cut the gage 52 of the borehole (FIG. 3).

A pair of wear pads, generally designated as 26, are interfitted into face 16 of drag bit 10. The base 30 of wear pads 26 interlock within a tongue and groove type of slot 32 formed in drag bit body 12. A pair of support bolts 34 are threaded into support bolt holes 35 (FIG. 3) to attach the wear pads 26 to the face 16 of drag bit 10. The support bolts are recessed into a slot 27 in the wear pads 26 so that after the wear pads 26 are bolted to the face of the drag bit, the slots are filled in with a wear pad material 36 to complete the assembly process.

One or more hydraulic passages 24 are drilled through face 16 of drag bit 10. The hydraulic passages 24 communicate with a hydraulic chamber 25 (FIG. 4) formed by the drag bit body 12. The inner edges 29 of pad 26 form hydraulic channel walls to direct mud across the face of the drag bit to cool and clean each of the diamond inserts strategically placed within face 16 of bit body 12. The face 28 of wear pads 26 is designed to wear down and conform to the borehole bottom to affect a hydraulic seal between the borehole bottom and face 16 of rock bit 10. The wear pads are preferably fabricated from an ultrahigh molecular weight polyethylene. Such a material is manufactured by Ains Plastic of Mount Vernon, New York. Another suitable wear pad material would be a variety of trowel mixes. These trowel mixes (metallic substance mixed with an epoxy binder) are a product of, for example, Rexnord, a Division of Norton Industries of Milwaukee, Wisconsin. Examples of trowel mixes are: bronze, aluminum, steel and carbide (tungsten carbide or silicon carbide material mixed with an epoxy binder).

Yet another suitable wear pad material would be selected from the plastic family, such as, TEFLON or polyurethane.

The tips 19 of diamond inserts 18 extend just beyond the face 28 of wear pads 26 so that the tips of each of the strategically placed inserts 18 first contact the borehole bottom. As the wear pad 26 wears down, the tips 19 of the inserts will continue to penetrate the rock bit and as the diamond inserts wear down, the pads wear down at a consistent rate so that the diamond drag bit will continue to advance in the borehole.

The thickness of the wear pads 26 prevents the entire diamond insert from embedding itself in the borehole bottom. Experience has shown that if the whole of the diamond insert is buried in the borehole bottom, the insert may well be overstressed and fracture. By allowing just the tip of the diamond inserts 18 to penetrate the borehole bottom, the insert is therefore protected by the wear pads from breakage. As stated before, the diamond inserts and wear pads wear down at the same rate thereby continually exposing the tips of the diamond inserts to the borehole bottom as the bit is advanced in the hole.

The body 12 of the drag bit 10 has a pair of bit breaker slots 38 below the face of the rock bit to facilitate removal of the drag bit from the drill string or drill collar.

Figure 2:
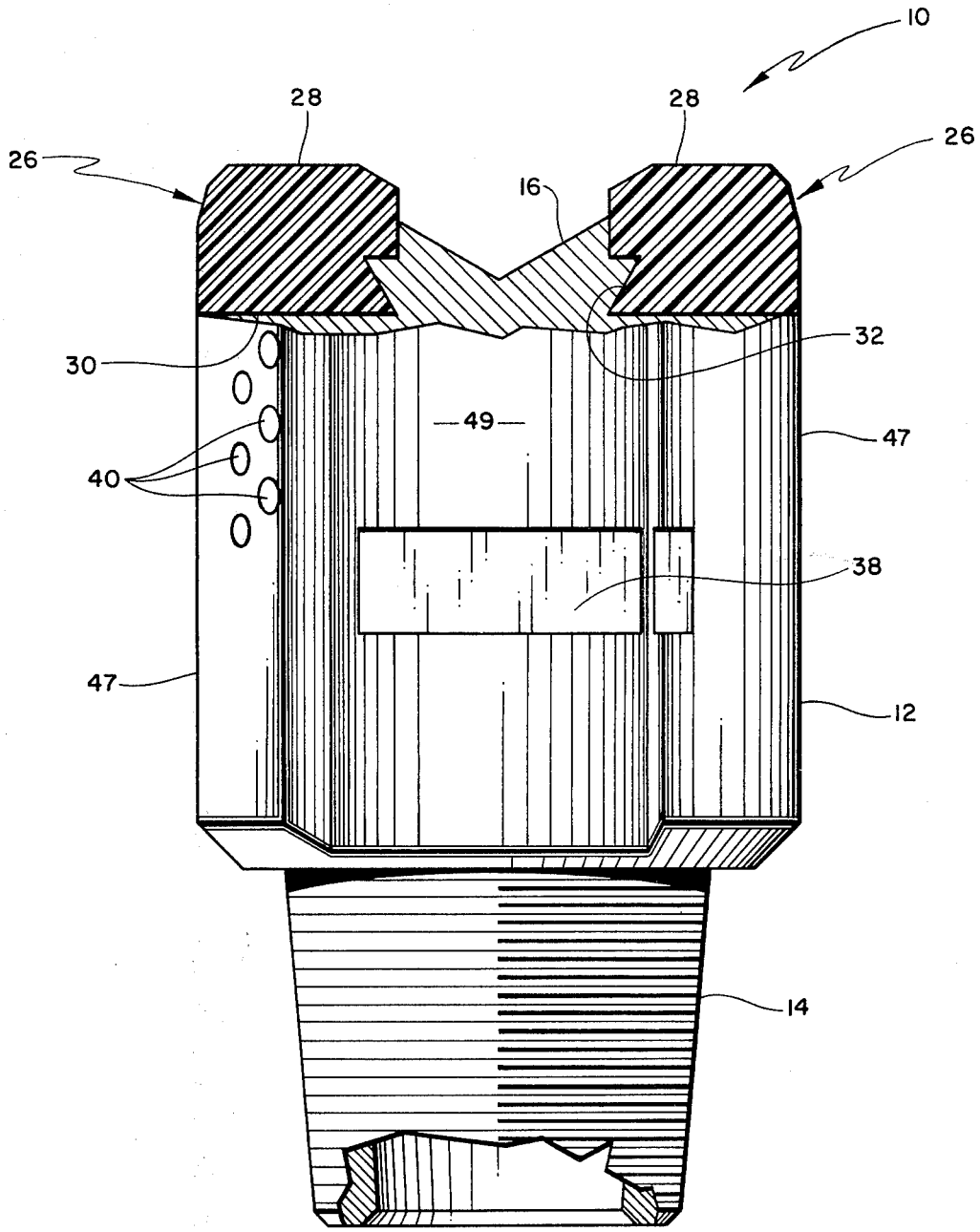
FIG. 2 is a partially cutaway side view of the drag bit illustrating the positioning of the wear pads on either side of the drag bit.

Turning now to FIG. 2, this view illustrates the bit breaker slot 38 on one side of the drag bit body 12. Obviously, a similar slot is positioned 180° from the slot as shown in FIG. 2. The bit body additionally may have a number of flush type tungsten carbide inserts or "buttons" 40 placed in the drag bit wall to reduce wear on the bit body. This view further illustrates the means in which the wear pads 26 are interlocked within the tongue and groove slot 32 to lock the wear pads into the bit body 12 by way of the retention bolts 34 (FIG. 1).

Turning to FIG. 3, the top view illustrates the strategic location of each of the diamond inserts 18 with the gage row inserts 20 positioned around the surface 17 of bit body 12 to maintain the gage of the borehole. This view illustrates a pair of hydraulic openings or nozzles 24 positioned in face 16 of bit body 12. Inner surface 29 formed by the inner edges of the wear pads 26 form the walls for the hydraulic channel across the face of the bit. Hydraulic fluid or mud exits from nozzle 24 and flows across the face 16 of bit body 12 to cool and clean and to remove the detritus material from the borehole bottom. The fluid carrying the detritus material flows up past the bit body 12 through channels 50 formed between the side of bit body 12 and the walls of the borehole 52.

Figure 4:
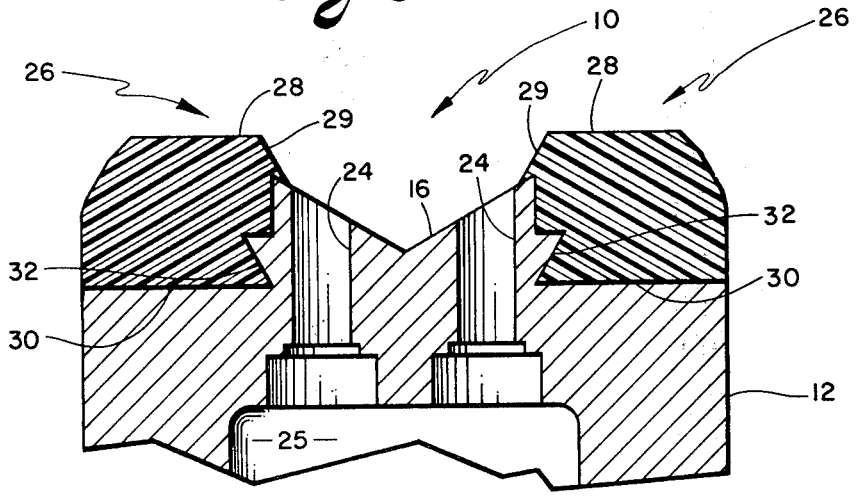
FIG. 4 is a partially cutaway side view taken through 4—4 of FIG. 3 illustrating a pair of hydraulic passages that communicate with a fluid chamber formed by the drag bit body.

With reference to FIG. 4, it can readily be seen that the nozzles or passages 24 communicate with a hydraulic chamber 25 formed by bit body 12. This view illustrates again how the wear pads 26 are secured at their bases 30 to bit body 12 by interlocking with the tongue and groove slot 32 in bit body 12. The face 28 of the wear pad 26 wears down and maintains a seal between the borehole bottom and the face 16 of the bit body to affect a hydraulic seal to assure that the hydraulic fluid is directed through the channel formed by the wear pad walls 29 to cool and clean the diamond inserts within the face 16 of bit body 12.

With reference to FIGS. 1, 2 and 3, body 12 forms a pair of longitudinal passageways 49 on opposite sides of the bit 10 that communicate with the crossflow channel formed between wear pads 26. The longitudinal relieved section 49 serves to direct cuttings swept from the borehole bottom up the drill string and out of the hole. Section 47 of body 12 substantially contacts the gage surface of the borehole to affect a seal that continues from the surface of the wear pads contacting the borehole bottom and up the sides of the borehole the length of the drag bit. By sealing a portion of the borehole, hydraulic action more effectively scavenges the detritus material from the borehole bottom while cleaning and cooling the diamond cutters 18 and 20.

It will of course be realized that various modifications can be made in the design and operation of the present invention without departing from the spirit thereof. Thus, while the principal preferred construction and mode of operation of the invention have been explained in what is now considered to represent its best embodiments which have been illustrated and described, it should be understood that within the scope of the appended claims, the invention may be practiced otherwise than as specifically illustrated and described.

I claim:

1. A diamond studded insert drag bit apparatus having a multiplicity of individual diamond insert cutter blanks inserted in the face of said bit, said bit forming at least one hydraulic passage that communicates between the face of the bit and an interior chamber formed by said bit, said bit comprising:

a substantially cylindrical drag bit body having a relatively flat first face end and a second pin end, and at least one wear pad having a support base at one end and a wear surface at an opposite end, said pad being attached to said first face end of said drag bit body at said support base of said wear pad, said wear pad is attached to said first face end of said drag bit body by at least one bolt recessed within said wear pad, said wear pad being positioned adjacent said multiplicity of diamond inserts, said wear surface extends beyond said first face end of said drag bit, the diamond cutting tips of said diamond insert cutter blanks extend partially beyond the wear surface of said pad, said pad forms at least one hydraulic passage between said first face end of said drag bit and a borehole bottom to direct hydraulic fluid exiting said at least one hydraulic passage over said adjacent multiplicity of diamond inserts to cool and clean said inserts and to remove detritus material from said borehole bottom, said wear pad assumes the shape of said borehole bottom to affect a hydraulic seal between said borehole bottom and said face of said drag bit.

2. The invention as set forth in claim 1 wherein said recessed area within said wear pad is filled in with a material comparable to said wear pad material.

3. The invention as set forth in claim 1 wherein a portion of said body of said drag bit extends out to the gage of said borehole to affect a seal along a longitudinal surface of said body between said body and a wall formed by said borehole to direct said detritus material through a relieved longitudinal portion formed by said drag bit body for removal of said material from said borehole bottom.

4. The invention as set forth in claim 3 wherein an outer peripheral edge of said at least one wear pad extends out to the gage of said drag bit body, said peripheral edge of said wear pad aligns with said portion of said body of said drag bit that extends out to said gage of said drag bit body.

5. The invention as set forth in claim 1 wherein said wear pad is fabricated from a trowel mix material.

6. The invention as set forth in claim 5 wherein said trowel material is bronze fragments mixed with an epoxy binder.

7. The invention as set forth in claim 5 wherein said trowel material is aluminum fragments mixed with an epoxy binder.

8. The invention as set forth in claim 5 wherein said trowel material is steel fragments mixed with an epoxy binder.

9. The invention as set forth in claim 5 wherein said trowel material is carbide particles mixed with an epoxy binder.

10. The invention as set forth in claim 9 wherein said carbide is tungsten carbide.

11. The invention as set forth in claim 9 wherein said carbide is silicon carbide.

12. The invention as set forth in claim 1 wherein said wear pad is fabricated from an ultrahigh molecular weight polyethylene.

13. The invention as set forth in claim 1 wherein said wear pad is fabricated from TEFLON.

14. The invention as set forth in claim 1 wherein said wear pad is fabricated from polyurethane.

* * * * *